US010699518B2

(12) United States Patent
Lee et al.

(10) Patent No.: US 10,699,518 B2
(45) Date of Patent: Jun. 30, 2020

(54) GAMING MACHINES WITH SOUND-GENERATING VIDEO DISPLAY DEVICES

(71) Applicant: AGS LLC, Las Vegas, NV (US)

(72) Inventors: Sigmund Hyunjai Lee, Atlanta, GA (US); Karl Frederick Zedell, Jr., Alpharetta, GA (US); Ian Scott, Duluth, GA (US)

(73) Assignee: AGS LLC, Las Vegas, NV (US)

( * ) Notice: Subject to any disclaimer, the term of this patent is extended or adjusted under 35 U.S.C. 154(b) by 8 days.

(21) Appl. No.: 15/907,362

(22) Filed: Feb. 28, 2018

(65) Prior Publication Data

US 2019/0266833 A1 Aug. 29, 2019

(51) Int. Cl.
*G07F 17/32* (2006.01)
*H04R 1/02* (2006.01)

(52) U.S. Cl.
CPC ..... *G07F 17/3213* (2013.01); *G07F 17/3216* (2013.01); *G07F 17/3288* (2013.01); *H04R 1/025* (2013.01); *H04R 1/028* (2013.01)

(58) Field of Classification Search
CPC ..... G07F 17/3213; G07F 17/3216; G07F 17/3288
USPC ..... 463/25
See application file for complete search history.

(56) References Cited

U.S. PATENT DOCUMENTS 5,784,054 A 7/1998 Armstrong et al.
6,342,831 B1 * 1/2002 Azima ..... H04R 7/045 340/384.1
2001/0022835 A1 * 9/2001 Matsuo ..... H04R 1/403 379/1.01
2003/0003879 A1 * 1/2003 Saiki ..... H04M 1/03 455/575.1
2003/0064804 A1 * 4/2003 Wilder ..... G07F 17/32 463/35
2004/0038722 A1 * 2/2004 Gauselmann ..... G07F 17/32 463/16
2004/0106449 A1 * 6/2004 Walker ..... G07F 17/32 463/25
2012/0322542 A1 * 12/2012 Chudd ..... G07F 17/3206 463/25

OTHER PUBLICATIONS

Darren Quick, "Sony's new Bravia OLED TV makes the screen the speaker," https://newatlas.com/sony-a1e-oled-tv-bravia/47255/, Jan. 5, 2017, 2 pages.
IntelliTouch® Surface Acoustic Wave SAW Touch Screen, "https://www.elotouch.com/intellitouch-surface-acoustic-wave-bezel.html," accessed Jun. 21, 2018, 7 pages.

* cited by examiner

*Primary Examiner* — Omkar A Deodhar
*Assistant Examiner* — Shauna-Kay Hall
(74) *Attorney, Agent, or Firm* — Weide & Miller, Ltd.

(57) ABSTRACT

A gaming machine includes at least one sound-generating display device. The sound-generating display device is configured to not only display information such as game information, but to generate sound. In one embodiment one or more transducers are mounted to a back or rear portion of a video display and cause one or more portions of the video display, such as a front panel thereof, to move, thus generating sound. The one or more transducers are controlled to generate sound, including to generate sound which has sound which is perceived to emanate from particular areas of the video display.

13 Claims, 3 Drawing Sheets

FIG. 3
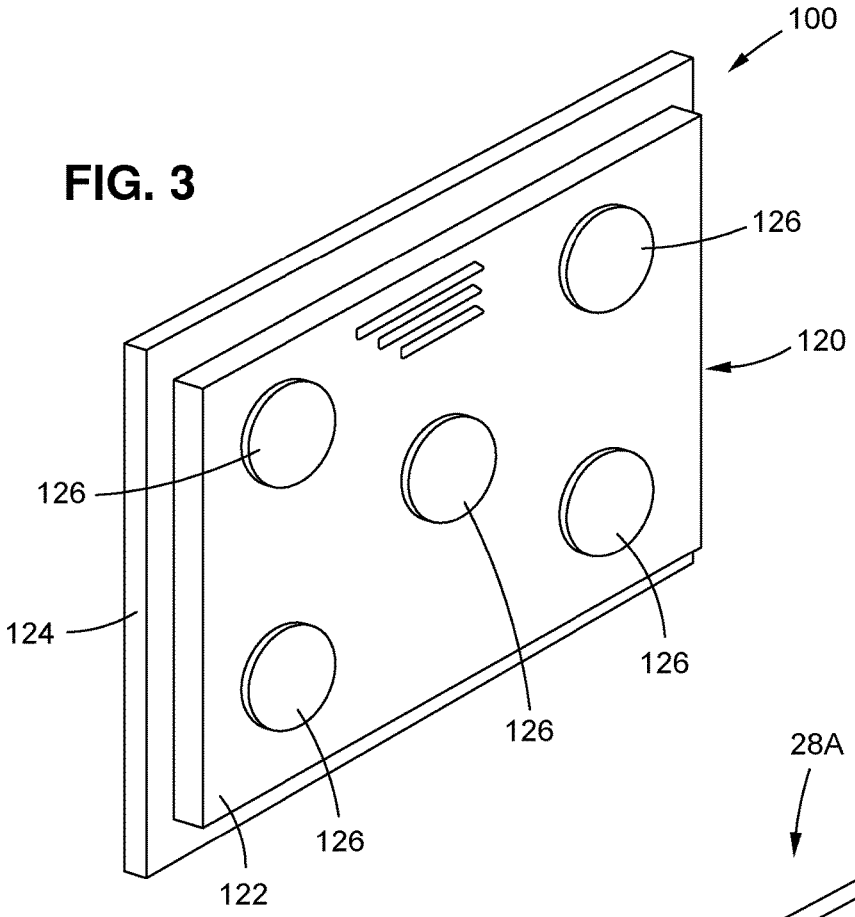
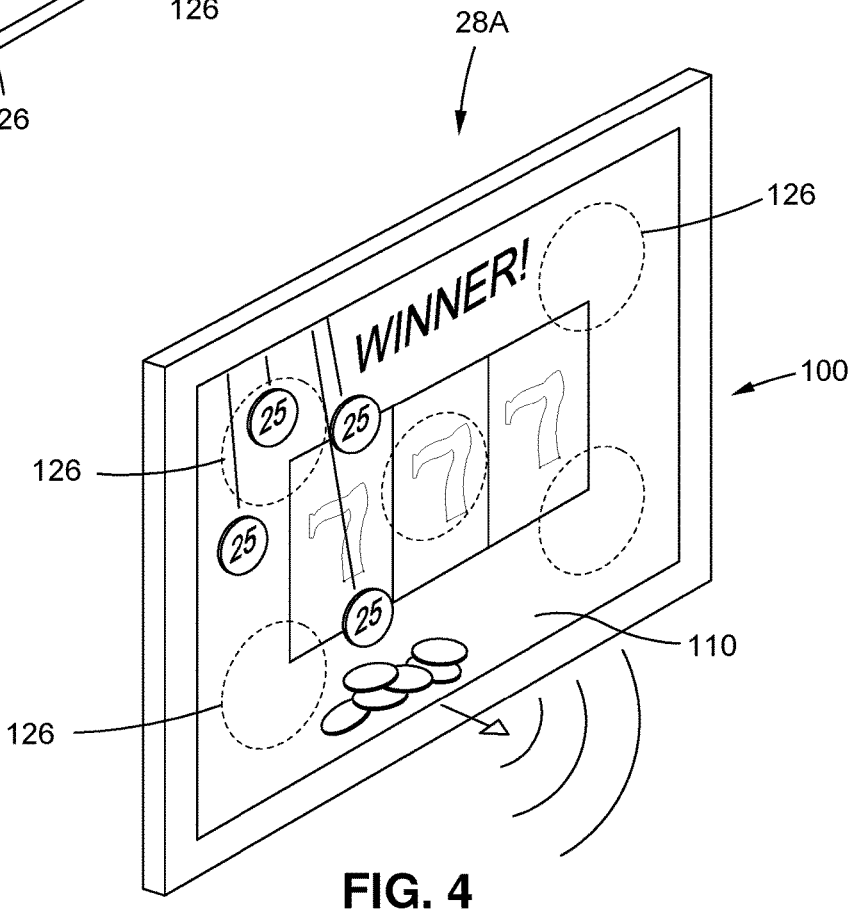
FIG. 4

GAMING MACHINES WITH SOUND-GENERATING VIDEO DISPLAY DEVICES

FIELD OF THE INVENTION

The present invention relates to gaming machines which are configured to present wagering games.

BACKGROUND OF THE INVENTION

Gaming machine manufacturers continually seek ways to make their gaming machines more inviting to players. One way to make the game play experience more exciting is to present the player with a realistic and stimulating video and audio environment. For example, gaming machines have evolved from having small, low resolution CRT displays to multiple high-resolution video displays.

As another example, gaming machines have been developed which include complex sound systems. These sound systems may, for example, include multiple speakers which are designed to produce a surround-sound experience or the like. For example, U.S. Pat. No. 9,504,919 describes a gaming machine having multiple speakers, including the ability to change the position of the speakers to vary the perceived vertical and/or horizontal location of the emitted sound. U.S. Patent Application Publication 2004/0142748 describes a surround sound system for a gaming machine where the system may include, for example, speakers mounted on an associated player chair or the like.

However, there are various obstacles that make the implementation of such audio and video features difficult. One problem is that the gaming machines must generally have a small size or "footprint" so that they take up a minimal amount of space on the casino gaming floor (thus allowing the casino to have space for larger numbers or gaming machines and other features such as gaming tables). Thus, the manufacturer must fit a large number of components into a relatively small space, thus often making it difficult to include all of the desired components.

As one example, when gaming machines had small CRT displays, there was generally sufficient space within the housing to fit speakers near the CRT display. However, as the CRT displays were replaced with much larger LCD and similar displays, placement of the speakers became more difficult.

As another example, while U.S. Pat. No. 9,504,919 describes a system where multiple speakers may be located to either side of the video displays, this configuration is often unworkable in many newer gaming machines where there is little or no space between the sides of the video display and the adjacent sides of the gaming machine housing, or where the video display is mounted on a mount or the like and there is no housing within which the speakers may be mounted next to the display. Further, in configurations like U.S. Patent Application Publication 2004/0142748, it may be much more costly and complex to try and mount speakers apart from the gaming machine, such as on a player chair.

As yet another example, U.S. Patent Application Publication 2004/0038722 discloses a configuration in which glass advertising/name panels, known in the industry as the "belly glass" and the "top glass", are used to generate sound. As noted in that application, such a configuration may be used to essentially create large speakers to overcome problems associated with using small conventional speakers where there are space constraints. However, this configuration has a number of drawbacks. First, the belly glass and top glass of gaming machines are typically printed with the name of the gaming machine and other artwork, and they may thus be changed or updated. Thus, adding sound-generating features to them makes the cost of updating or changing that glass unnecessarily expensive. Also, such belly and top glass panels are normally located at the bottom and the top of the gaming machine, such that any sound that emanates from them will sound to the player as if it is coming from a remote location.

A new configuration for a gaming machine which addresses these and other issues is desired.

SUMMARY OF THE INVENTION

Embodiments of the invention comprise gaming machines with sound-generating video displays and methods of generating sounds at a gaming machine.

One embodiment of the invention comprises a gaming machine comprising a cabinet defining at least one interior space, at least one sound-generating display device, at least one player input device, a memory device, a controller, and machine-readable code stored in the memory device and executable by the controller to present one or more wagering games comprising the display of game information via the at least one sound-generating display device and the generation of sound via the at least one sound-generating display device.

In one embodiment, the sound-generating display device comprises a generally flat panel electronic video display having a front and a rear, a display panel located at the front which is configured to display information, and one or more transducers mounted to the rear of the video display and configured to cause the video display to generate sound as a result of movement of one or more portions thereof by the one or more transducers.

In one embodiment, a plurality of transducers is mounted to the rear of the video display. The flat panel electronic display may comprise, for example, an LCD or LED-type display wherein the transducers are configured to cause the video display to generate sound as a result of movement of the front display panel.

In one embodiment, the sound-generating display device may be a primary display of the gaming machine, such as located at a front of the gaming machine. The gaming machine might also include other non-sound generating display devices or might comprise multiple sound-generating display devices. The gaming machine might also include additional traditional speakers.

In one embodiment of a method, a sound-generating display device of a gaming machine is configured to display information such as game information and is controlled to generate sound by activating the one or more transducers and to cause them to move one or more portions of the video display. In one embodiment, the transducers are selectively activated to create sound having a perceived source which corresponds to a portion of the video display at which certain information is being displayed.

Further objects, features, and advantages of the present invention over the prior art will become apparent from the detailed description of the drawings which follows, when considered with the attached figures.

DESCRIPTION OF THE DRAWINGS

FIG. 3 illustrates the rear of a sound-generating display in accordance with the present invention; and FIG. 4 illustrates a front of a sound-generating display in accordance with the present invention as used to display certain information and generate sound having a designated perceived location.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise gaming machines. The gaming machine of the present invention is preferably configured to present one or more wagering or casino-style games to one or more players. Preferably, the gaming machine has at least one sound-generating video display.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
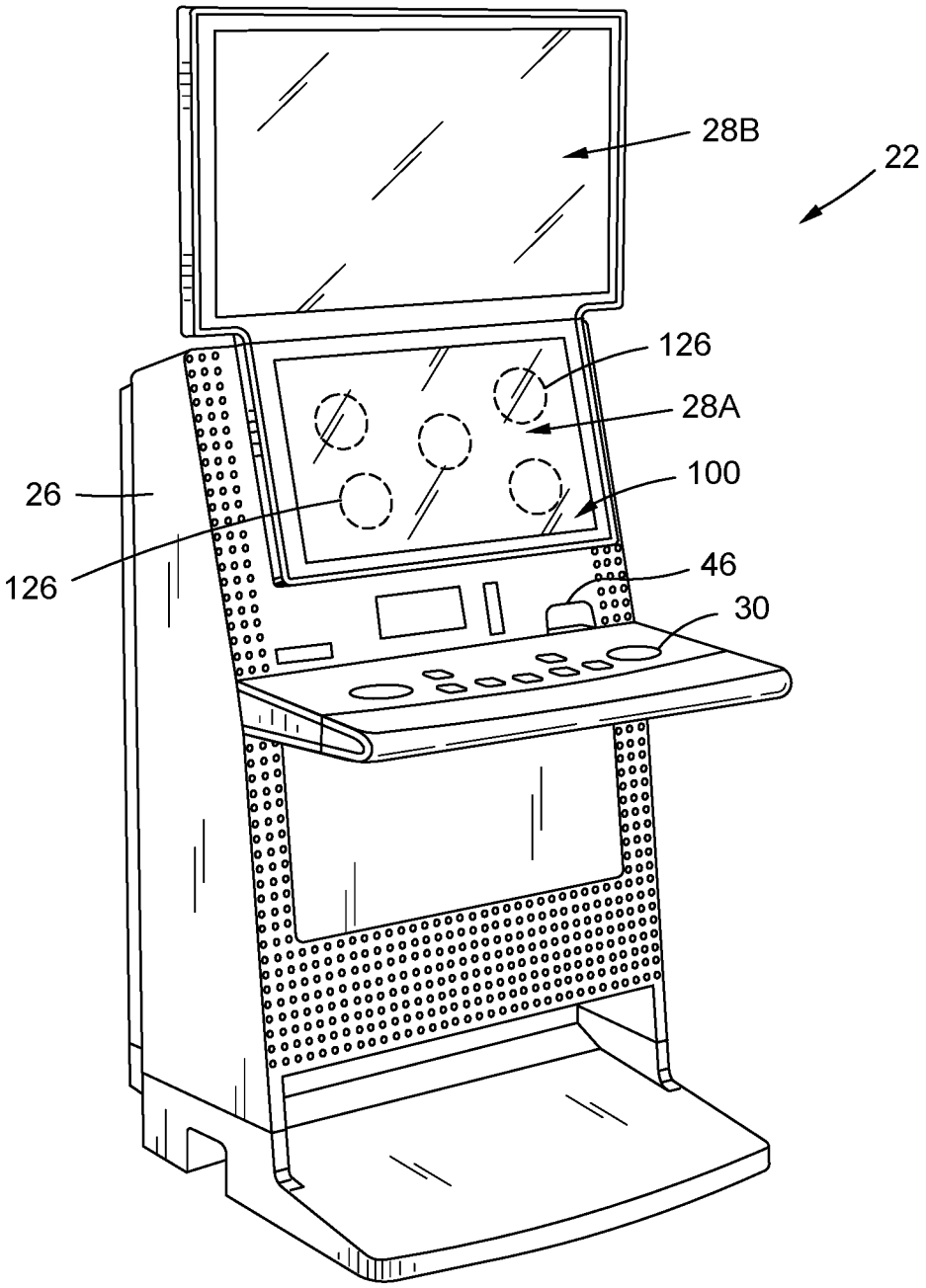
FIG. 1 is a perspective view of one embodiment of a gaming machine having a sound-generating display in accordance with the invention.

One configuration of a gaming machine 22 is illustrated in FIG. 1. As illustrated, the gaming machine 22 generally comprises a housing or cabinet 26 for supporting and/or enclosing various components required for operation of the gaming machine. The housing 26 of the gaming machine 22 may include one or more doors or panels (not shown) capable of being moved between an open position which allows access to the interior of the gaming machine, and a closed position in which access to the interior is generally prevented. The configuration of the gaming machine 22, including its shape and dimensions, may vary. For example, the gaming machine might have the generally known configuration of an "upright", a "slant"-type or a "bar-top" machine, or have other configurations.

The gaming machine 22 preferably includes at least one display device which is configured to display game information. In the embodiment illustrated, the gaming machine 22 include a first display 28A and a second display 28B. The display devices 28A,B may be capable of projecting or displaying a wide variety of information, including images, symbols and other indicia or information associated with game play, game promotion or other events. In the illustrated embodiment, the first or main display 28A is located at a front of the housing 26, such as by being mounted to a front access door (not visible), and the second or secondary display 28B is located above a top of the housing 26, such as by being mounted to a display support which extends upwardly from the housing. Of course, the gaming machine 22 might include additional displays (such as a third display), or might only include a single display, and might include various types of displays (in one embodiment, as described below, at least one of the displays comprises a generally flat panel video display, such as an LCD display, but other of the displays might be of different types, including other types of video displays and devices such as physical spinning reels). In addition, the display devices might be associated with the housing a top box or other portion of the gaming machine (including by being associated with various types of exterior mounts).

As described in more detail below, the gaming machine 22 is preferably configured to present one or more games upon a player making a monetary payment or wager. In this regard, as described in more detail below, the gaming machine 22 includes mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to initiate a reel spin, to "cash out" of the gaming machine, or to provide various other inputs.

Figure 2:
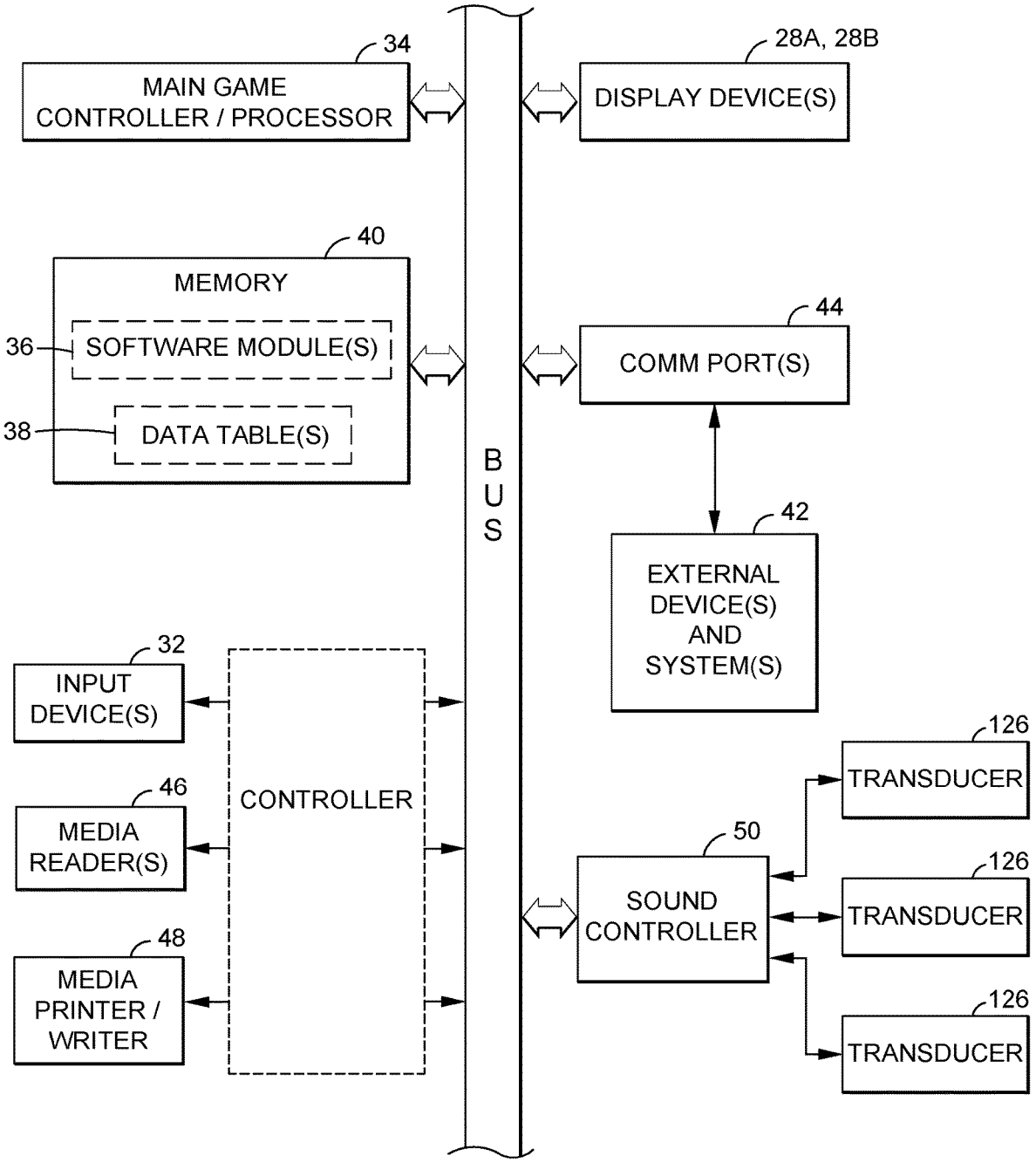
FIG. 2 diagrammatically illustrates a configuration of the gaming machine illustrated in FIG. 1.

Referring to FIG. 2, in one preferred embodiment, the gaming machine 22 includes at least one microprocessor or controller 34 for controlling the gaming machine, including receiving player input and sending output signals for controlling the various components or peripheral devices of the machine 22 (such as generating game information for display by the display devices 28A,28B). The controller 34 may be arranged to receive information regarding funds provided by a player to the gaming machine 22, receive input such as a purchase/bet signal when a purchase/bet button is depressed, and receive other inputs from a player. The controller may be arranged to generate information regarding a game, such as generating game information for display by the at least one display device 28A,28B, for determining winning or losing game outcomes and for displaying information regarding awards for winning game outcomes, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory may also store other information or data 38, such as data stored in table or other forms (including, but not limited to sound files, image files, look-up tables, pay tables and other information including tracked game play information). The gaming machine 22 may also include one or more random number generators for generating random numbers (such as implemented by a random number generator software module stored in the memory 40 and executable by the processor 34), such as for use in selecting game symbols and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller 34 is configured to execute machine readable code or instructions (e.g. software) which is configured to implement the game. In this regard, the gaming machine 22 is specially configured to present games via specific software and/or hardware which causes the gaming machine to operate uniquely. For example, the controller 34 of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices or systems 42 at one or more times. The gaming machine 22 might communicate with one or more of such external devices or systems 42 via one or more communication ports 44 or other interface devices. These ports or interface devices 44 may be configured to implement various communication protocols (including proprietary protocols) and communicate via wireless, wired or other communication link. For example, the gaming machine 22 may be configured as a server based device and obtain game code, sound files, game outcome information or other information from a remote game server (in which event the gaming machine controller may receive game information from the server, such as game outcome information, and use that server-generated information to present the game at the gaming machine). For example, the gaming machine 22 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 22 is configured to present one or more wagering games. The gaming machine 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, the gaming machine 22 might include a coin acceptor for accepting coins. Of course, associated coin reading/verifying devices and coin storage devices may be associated with the gaming machine 22 if it is configured to accept coins. Likewise, as illustrated in FIGS. 1 and 2, the gaming machine 22 might include a media reader 46. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to one of the player input devices 30 which designates an input of a wager of a certain number of credits (such as "Bet 1Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 22 may include one or more media printers or writers 48, as illustrated in FIG. 2. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and/or an associated keypad or other input device (such as a touch screen display). Such player tracking devices are well known and may permit the game operator to track play of players of the gaming machine. The tracked play may be utilized to offer player bonuses or awards.

As illustrated in FIG. 2, the main game controller or processor 34 may communicate with several of the peripheral devices via one or more intermediary controllers. For example, some of the peripheral devices might comprise USB type or enabled devices which are controlled by an intermediary USB controller.

A casino may have a number of such gaming machines 22, such as located on a casino floor or in other locations. Of course, such gaming machines 22 might be used in other environments, such as an airport, a bar or tavern or other locations.

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described.

As noted above, the gaming machine might comprise a "server-based" or "thin client" type of device. In such a configuration, it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

In one embodiment of the invention, at least one of the display devices of the gaming machine 22 comprises a sound generating display device. For example, in a preferred embodiment of the invention, at least the first or main display 28A comprises a sound-generating display device. In a preferred embodiment, by "sound-generating display device", it is meant a video display device which is configured to not only display information but to generate sound or audio.

In one embodiment, referring to FIG. 3, the sound-generating display device 100 may comprise an electronic video display of the type which includes a generally thin and flat front surface or panel. Such a video display may comprise, for example, a liquid crystal display (LCD), projection LCD, plasma display, field emission display, digital micro-mirror display (DMD), digital light processing display (DLP), LCD touchscreen, a light emitting diode display (LED), organic LED (OLED) or other similar types of displays now known or later developed. Such devices may be configured to display information in a variety of resolutions, sizes and formats (e.g. 4:3, widescreen or the like).

In one embodiment, the sound-generating video display device 100 comprises a video display and one or more transducers 126 or other means or mechanisms for moving one or more portions of the sound-generating video display, and preferably portions of the video display.

The video display may have a housing 120 having a front (not visible in FIG. 3) which comprises or includes a generally flat display panel or surface. Edges of that panel may be enclosed or surrounded by a bezel 124. The video display portion also has a rear portion 122.

In one embodiment, the one or more transducers 126 are mounted to the video display portion of the sound-generating display device 100, such as the housing 120 thereof. In a preferred embodiment, the transducers 126 are mounted to the rear portion 122 of the housing 120.

As illustrated in FIGS. 1 and 3, a plurality of transducers 126 may be mounted to or otherwise associated with the housing 120, such as in various locations thereof. In this embodiment, five (5) transducers are illustrated, but other numbers (as few as one and greater than five) might be utilized.

The one or more transducers 126 are preferably configured, and located or mounted, so that they cause the display device to generate sound as a result of movement of one or more portions thereof. In one embodiment, the one or more transducers 126 cause the front panel of the video display portion of the sound-generating display device 100 to vibrate or move in a manner which generates desired sound.

As illustrated in FIG. 2, the main game processor 34 may be configured to interface with one or more sound controllers 50, such as by sending signals or instructions thereto. The sound controller 50 may, in turn, be configured to generate or transmit various outputs, such as electrical signals. These signals are transmitted to the transducers 126. In turn, the transducers 126 convert those signals into mechanical motion or movement, causing the display device 28A to move and thus generate desired sound.

In one embodiment, the sound controller 50 or other controller may be configured to send outputs to a single transducer 126 or combinations of transducers, including all of them, in order to create a desired sound effect, including a desired perceived location (and/or movement) of the sound. In one embodiment, the sound-generating display device 100 is controlled to cause it to generate sound which has a perceived location (perceived by a player of the gaming machine) which corresponds to the location of certain information which is displayed by the display. For example, as illustrated in FIG. 4, the sound-generating display device 100 might display game information comprising winning slot symbols and a plurality of gold coins dropping into a pile at the bottom of the front panel or screen 110. In this configuration, the transducer 126 which is located closest to the portion of the display where the coins are displayed may be activated to cause the sound-generating display device 100 to generate the sound of coins. In this configuration, the player perceives the sound as coming from the area of the video display where the coins are displayed, heightening the realism of the displayed event.

Of course, the transducers 126 might be controlled in various manners in order to generate various sounds or sound effects. Those sound effects are preferably coordinated with displayed game information, such as by the processor of the gaming machine causing the one or more displays to display information at the same time as the sound controller 50 controls the transducer(s) 126 to generate sound. Various sound effects may be generated by the transducer(s) 126 in coordination with displayed information. For example, the transducer(s) 126 may be activated to cause them to create the sound of spinning slot wheels in the location of (e.g. having a perceived location of) that portion of the display where such reels are being displayed to a player. The transducer(s) 126 may be activated to cause them to generate directionally emotive sounds corresponding to, and perceived as emanating from the location of, on-screen displayed animations (including displayed characters as the like). For example, the transducer(s) 126 may be activated to cause them to generate voice information in the location of a displayed animated character so that the player perceives the voice as coming from the character. As another example, relative to features such as multi-level progressive meters, the transducer(s) 126 may be activated to cause them to generate unique sounds emanating from the area where the meters/credits are being incremented (for example, at the start such a meter may be at the bottom of the screen and the corresponding sound of the meter being incremented may be generated so that it matches that location, while as the meter increments upwardly, the perceived location of the sound may be generated at higher positions and may be generated so that the sounds is moving upwardly).

In one embodiment, the gaming machine 22 might include one or more secondary traditional speakers, if the design of the gaming machine permits such. For example, while the size of the gaming machine might not permit traditional speakers to be mounted to the sides of the main display 28A, there might be sufficient space for a subwoofer to be located in a bottom portion of the interior of the housing 26.

In addition, while in the above-described embodiment only the main display 28A is configured as a sound-generating display device 100, it will be appreciated that other displays of the gaming machine might instead be configured as sound-generating display devices and/or additional displays might be configured as sound-generating displays. For example, relative to the gaming machine 22 illustrated in FIG. 1, both the main display 28A and the secondary display 28B might be configured as sound-generating display devices.

Also, while in one embodiment one or more transducers 126 are utilized to move a display panel of a video display portion of the sound-generating display device 100, other means for moving portions of the video display to generate sound may be utilized and the transducers or other means may be used to move other portions of the video display to generate sound. For example, other types of devices might be used to cause the front panel or other portions of the sound-generating display device to move and thus generate sound.

In one embodiment, the transducers 126 are mounted to a rear 122 of a housing 120 of the video display portion of the sound-generating display device 100. The transducers 126 (or other mechanisms/means for moving) may be mounted in other manners or locations. For example, they might be mounted to the inside surface of the housing 120 at the rear thereof. In another embodiment, they might be mounted to brackets or other structures, housings or elements which are connected to the housing 120 or the like.

The invention has numerous advantages. One advantage of the invention is a gaming machine which includes one or more sound-generating display devices. These display devices provide dual functionality, that of displaying video/graphical information and providing or generating sound, within generally the same space as a regular video display. Thus, in situations where there are space constraints for locating both video displays and separate traditional speakers, the present invention overcomes those issues because a separate space for one or more speakers is no longer required.

In addition, one advantage to the invention is that the sound-generating display device generates or emits sound in the same location as displayed information (graphics, etc.). Thus, the player's gaming experience is enhanced because the visual and audio aspects are aligned as they are in the real world—e.g. the sound is perceived as coming from the event or item which is generating the sound. Thus, the sound-generating display of the present invention causes the generated to audio to be more realistic than when the gaming machine includes conventional speakers which are located in a variety of locations apart from the video display(s).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a cabinet defining at least one interior space;

at least one sound-generating display device comprising a generally flat panel electronic video display having a front and a rear, a display panel located at said front which is configured to display information and a plurality of transducers mounted to rear of said video display and configured to cause said video display to generate sound as a result of movement of one or more portions thereof by said one or more transducers;

at least one player input device;

a memory device;

a controller; and machine-readable code stored in said memory device and executable by said controller to present one or more wagering games comprising causing said at least one sound-generating display device to display game information and causing one or more of said plurality of transducers to generate sound which has a perceived source corresponding to a location of said video display at which a sub-portion of said game information is displayed by said video display.

2. The gaming machine in accordance with claim 1 wherein said flat panel electronic display comprises an LED-type display.

3. The gaming machine in accordance with claim 1 wherein said transducers cause said video display to generate sound as a result of movement of said display panel.

4. The gaming machine in accordance with claim 1 wherein said at least one sound-generating display device is located at a front of said cabinet.

5. The gaming machine in accordance with claim 1 wherein said at least one sound-generating display device is mounted to a door of said cabinet.

6. The gaming machine in accordance with claim 1 wherein said at least one sound-generating display device comprises a first main sound-generating display device and a secondary sound-generating display device.

7. The gaming machine in accordance with claim 6 wherein said secondary sound-generating display device is positioned above said first main sound-generating display device.

8. The gaming machine in accordance with claim 1 further including one or more secondary sound generating devices comprising speakers mounted to said cabinet.

9. The gaming machine in accordance with claim 1 wherein said location comprises a sub-portion of said video display.

10. The gaming machine in accordance with claim 1 wherein said machine-readable code stored in said memory device and executable by said controller causes a first one or more of said plurality of transducers to generate sound which has a perceived source corresponding to a first location of said video display at a first time and causes a second one or more of said plurality of transducers to generate sound which has a perceived source corresponding to a second location of said video display at a second time, said second location being different than said first location and said second one or more of said plurality of transducers being different than said first one or more of said plurality of transducers.

11. The method in accordance with claim 10 wherein said first location corresponds to first displayed game information and said second location corresponds to second displayed game information.

12. A method of presenting a wagering game to a player of a gaming device comprising the steps of:

accepting a wager from said player;

displaying game information by at least one sound-generating display device comprising a generally flat panel electronic video display having a front and a rear, a display panel located at said front which is configured to display information and a plurality of transducers mounted to rear of said video display configured to cause said video display to generate sound as a result of movement of one or more portions thereof by said at least one transducer to display game information; and selectively activating one or more of said plurality of transducers to generate sound which has a perceived source corresponding to a location of said video display at which a sub-portion of said game information is displayed by said video display.

13. The method in accordance with claim 12 comprising selective activating a first one or more of said plurality of transducers to generate sound which has a perceived source corresponding to a first location of said video display at a first time and selectively activating a second one or more of said plurality of transducers to generate sound which has a perceived source corresponding to a second location of said video display at a second time, said second location being different than said first location and said second one or more of said plurality of transducers being different than said first one or more of said plurality of transducers.

* * * * *